United States Patent [19]

Herrin et al.

[11] Patent Number: 4,858,756

[45] Date of Patent: Aug. 22, 1989

[54] CONTAINER

[75] Inventors: Melvin B. Herrin, Meadowbrook; Richard Mazurek, Rockledge, both of Pa.

[73] Assignee: Klearfold, Inc., Warrington, Pa.

[21] Appl. No.: 526,028

[22] Filed: Aug. 24, 1983

Related U.S. Application Data

[63] Continuation of Ser. No. 271,359, Jun. 15, 1981, abandoned, which is a continuation-in-part of Ser. No. 175,404, Aug. 5, 1980, abandoned.

[51] Int. Cl.[4] ..... B65D 25/00

[52] U.S. Cl. ..... 206/45.34; 206/45.31

[58] Field of Search ..... 206/45.34, 41.31

[56] References Cited

U.S. PATENT DOCUMENTS

| | | | |
|---|---|---|---|
| 2,529,128 | 11/1950 | Bergstein | 229/23 R |
| 3,404,774 | 10/1968 | Levine | 206/464 |
| 3,608,705 | 9/1971 | Moshel | 206/23.34 |
| 3,746,242 | 7/1973 | Troth | 206/45.34 |
| 3,904,029 | 9/1975 | Koltz | 206/45.34 |
| 3,985,232 | 10/1976 | Johnson | 206/461 |

*Primary Examiner*—Joseph Man-Fu Moy

*Attorney, Agent, or Firm*—Lerner, David, Littenberg, Krumholz & Mentlik

[57] ABSTRACT

The present invention provides an improved box and display package made of plastic and paperboard, or plastic and another type of substantially rigid, self-supporting material. Thus, there is provided a package made of a first sheet of plastic substantially rigid, self-supporting material, a second sheet of substantially rigid, self-supporting material, joining means joining the sheets together to form a unified composite package, and discrete fold lines in the package including at least a pair of discrete fold lines in the first sheet of material, and wherein the discrete fold lines are disposed and constructed to cooperate to form a walled enclosure when the package is in its setup condition, to form a substantially flat configuration when the package is in its fully collapsed condition, and to be moveable between its setup condition and fully collapsed condition by movement of the walls of the walled enclosure relative to each other so that it can be readily setup and collapsed by hand and by standard packaging machinery.

20 Claims, 5 Drawing Sheets

FIG. 1
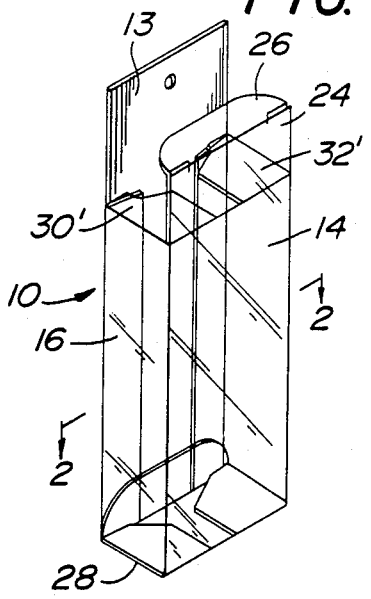
FIG. 2
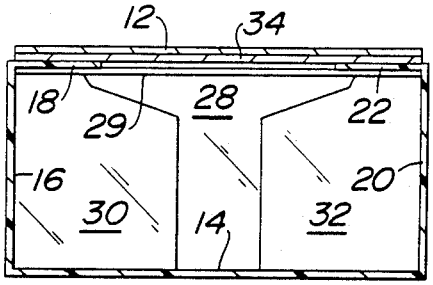
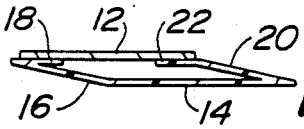
FIG. 3
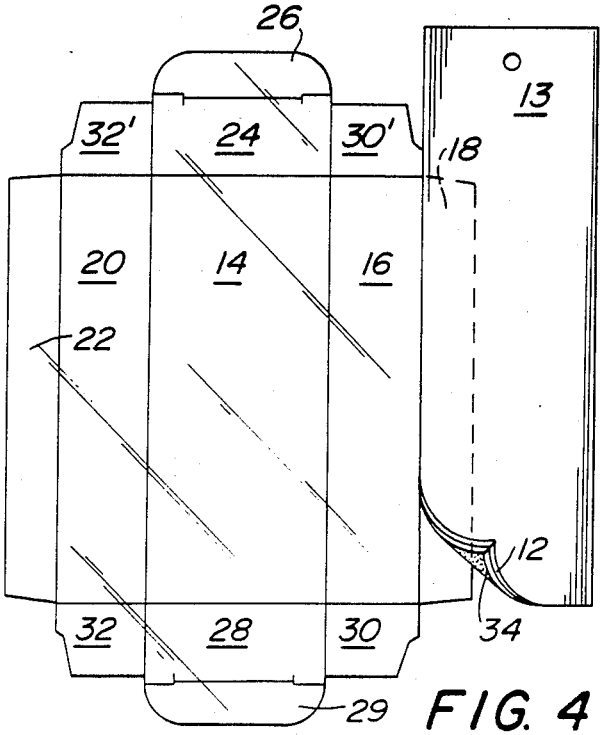
FIG. 4
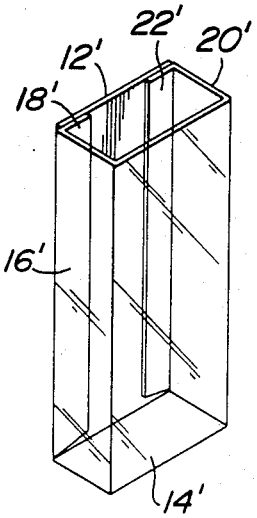
FIG. 5

CONTAINER

This is a continuation of our prior application Ser. No. 271,359, filed June 15, 1981, which was a continuation in part of our prior application Ser. No. 175,404, filed Aug. 5, 1980, both of which have been abandoned.

DESCRIPTION

1. Technical Field

This invention relates to an improved box and display package made of plastic and paperboard or another type of substantially rigid, self-supporting material, and, in particular, to a combination plastic and paperboard container which economically utilizes the advantages of both materials without many of their disadvantages, and which can be shipped as a unit in a substantially flat configuration and can be setup, filled, and closed by standard packaging machines.

2. Background Art

Combination plastic and paperboard containers are well known as evidenced by U.S. Pat. Nos. 1,938,490; 1,951,249; 3,215,267; 3,480,138; 3,527,346; 3,608,705; 3,746,242; and 3,904,029. The foregoing patents include blister type packages, window display type packages, paperboard packages with plastic inserts or vice versa, and boxes made of plastic and paperboard. While each provides the advantages of certain of the most desirable characteristics of both paperboard and plastic, no one container maximizes such advantages and is also capable of being shipped in a substantially flat configuration and can be setup, filled, and closed by standard packaging machines.

Of course, there are a great number of paperboard containers which can be setup, filled, and closed by standard paperboard folding carton machinery. An example of a paperboard hanging package which can be processed by such machinery is disclosed in U.S. Pat. No. 3,985,232. It is constructed from a single sheet of paperboard. Similar types of all plastic containers made from a single sheet of material are also known. Of course, containers made from more than one sheet of material are also well known and an example of a plastic container made from two sheets of the same material can be found in U.S. Pat. No. 1,992,087.

Blister packages, although unpopular with most customers mainly because they are difficult to open, are in common use today. Packages of this type comprise a molded shell or blister of transparent plastic heat sealed to a generally planar base element, usually of fibrous material, such as paperboard. Identifying indicia or advertising matter are printed on that side of the paperboard to which the blister of plastic is affixed, following which the board is coated with a thermoplastic material to which the blister is heat sealed by means of peripheral flange which extends outwardly from the blister. Advantages of blister packages include visual display of the product which appeals to persons having impulse buying habits, limited protection of the product from deterioration as for example by atmospheric moisture or other causes, pilfer-proof protection, and protection of the product from rough handling both in shipment and by potential customers.

However, blister packages have a number of drawbacks. Molding of the blisters requires the use of very expensive molds, and even the production of a sample blister necessitates the making of a costly wood mold. The blisters and paperboard backings must be shipped separately from the manufacturer to the user, and the latter must have expensive equipment for heat sealing the blister to the paperboard after insertion of the product or products into the cavity of the blister. The coating of synthetic plastic applied over the printed surface of the paperboard tends to lessen the quality and appearance of the printed matter. Although the blister can be printed, this can only be accomplished at great expense and trouble. Another undesirable aspect of the common form of blister package is that it cannot stand up at one end, but either must be suspended, as for example on a punch board, or laid flat. A particularly disadvantageous feature of the common blister package is that the package is very difficult to open and is ordinarily destroyed in the act of being opened, for opening involves delamination or destruction of the paperboard. Thus, if the package contains a plurality of items (e.g. nuts and bolts), after opening, the entire contents of the package must be removed and those items which are not immediately used must be stored in some type of container, such as a jar.

Another form of package widely used to display goods is that made entirely from transparent synthetic plastic material. Although such packages can be fabricated from a sheet of transparent plastic and shipped in a flat condition to the user where they are set up and filled, they too have certain disadvantages. Being substantially clear or transparent, it may be necessary to coat portions thereof with an opaque ink, for example a white ink, in order that other indicia or advertising material printed thereon will be legible. Furthermore, printing of plastic sheet is rather expensive. Rigidity of the packages is limited and is not readily increased merely by increasing the thickness of the plastic sheet material, since there are mechanical limitations involved in using thicker sheets, as well as the self-defeating aspect of the increased cost of such plastic sheets.

DISCLOSURE OF THE INVENTION

According to the present invention, there is provided a package made of a first sheet of plastic substantially rigid, self-supporting material, a second sheet of substantialy rigid, self-supporting material, joining means joining the sheets together to form a unified composite package, and discrete fold lines in the package including at least a pair of discrete fold lines in said first sheet of material, said discrete fold lines being disposed and constructed to cooperate to form a walled enclosure when the package is in its setup condition, to form a substantially flat configuration when the package is in its fully collapsed condition, and to be moveable between its setup condition and fully collapsed condition by movement of the walls of said walled enclosure relative to each other so that it can be readily setup and collapsed by hand and by standard packaging machinery. Preferably, the second sheet of material is paperboard.

In a preferred embodiment of the invention, the joining means comprises a pair of flap members which join the sheets together in such a fashion that the only overlapping material in the setup package is the flap members. Thus, each sheet of material forms at least one wall of the enclosure and the package uses the minimum materials needed to form it.

In another preferred embodiment, the paperboard is so shaped that it can be die cut from sheets of paperboard with minimum waste, i.e. rectangular or triangular. In yet another preferred embodiment, the paperboard does not include any fold lines and includes hanging means (such as a hole or tab) for forming a blister-type package. Further, the closure means can be of the reuseable type.

In a preferred embodiment of the invention, the front wall and connecting walls are formed of a single sheet of transparent or translucent plastic material, the connecting walls being joined to the rear wall which is made of paperboard.

In that embodiment of the invention in which the package fulfills the purpose of a blister package, the connecting walls preferably are joined or bonded to the front surface of the rear wall, which later wall is longer than the front wall measured in a vertical direction, and is provided with an aperture for hanging the package from a punchboard or the like. The package also has opposing walls which may be top and bottom, or side walls which, by their construction, facilitate access to the interior of the package one or more times as desired. Regardless of whether the packages or containers of this invention are intended for use as a replacement for blister packages or wholly transparent display packages, the novel packages have an advantage in that they can be shipped in a flat condition and, employing ordinary automatic packaging equipment, can be set up at very high speeds into erected packages into which the goods are placed.

The advantages of the packages of this invention are considerable. As compared to blister packages, the new packages, as noted above, comprise a unitary structure which may be shipped in a flat condition, rather than in separate pieces. The provision of expensive molds for forming the blisters is avoided. Neither is the user required to have available expensive equipment for uniting a blister with a paperboard backing. Rather all that is needed is standard automatic folding paperboard carton equipment. Also, the containers can be easily manually set up and/or filled and/or closed. Further, since the transparent plastic portion of the packages is attached to the backing merely by two opposing side or top and bottom walls, there is no need to coat the surface of the rear wall with a thermoplastic material, thereby avoiding problems of distorted or unclear printing.

Of particular importance in certain embodiments is the fact that the new packages, although providing the protection for the packaged goods heretofore provided by blister packages, nevertheless, are so designed that the integrity thereof is not destroyed when first opened. Rather, the packages are designed to permit access to the interior thereof whereby individual items may be removed and the packages resealed to protect the remaining items. Of course, by sealing shut the closure flaps, the package may be made pilfer-proof.

As stated, packages or containers of this invention find particular utility as less expensive replacements for display packages made entirely of transparent plastic material. The rear wall of the new packages being of an inexpensive material such as paperboard, provides the packages with greater strength and rigidity, as compared to packages formed wholly of transparent material, and at reduced cost. Because of the greater rigidity, the packages of this invention are easier to fill using standard folding box equipment. Printing costs may also be reduced inasmuch as printing of the rear wall is considerably simpler than printing of transparent plastic. Because the rear wall is opaque, no background color need be applied thereto in order to make the printing more legible. If desired, however, the transparent portion can also be printed at costs considerably below those involved in and with considerably less difficulty than, printing the blister of blister packages. Advantageously, a sheet of aluminum foil or the like may be adhered to the surface of the rear wall opposite the front wall to make the package more striking in its appearance.

A further advantage of certain embodiments of the invention resides in the fact that they can be manufactured in a single operation. In such embodiments, the two sheets of material are bonded together to form a container blank which is then made into a container in the usual fashion.

With these considerations in mind, it is a primary object of this invention to provide an economical novel type of container which may be used in place of the common form of blister package, which container has many of the various advantages of a blister package, as well as others, all as enumerated hereinabove, yet does not suffer from the shortcomings of a blister pack.

Another primary object of this invention is the provision of an economical novel display package which embodies the benefits of display packages made entirely of transparent plastic material, as well as other advantages, as heretofore described, while at the same time overcoming certain of the deficiencies of such prior known display packages.

Other objects and advantages of the present invention will become apparent from the following detailed description, drawings and appended claims.

BRIEF DESCRIPTION OF DRAWINGS

For the purpose of illustrating the invention, there are shown in the drawings forms which are presently preferred; it being understood, however, that this invention is not limited to the precise arrangements and instrumentalities shown.

FIG. 1 is a perspective view of a container in accordance with the present invention.

FIG. 2 is an enlarged sectional view taken along the line 2—2 in FIG. 1.

FIG. 3 is a sectional view similar to FIG. 2 but showing the container in a collapsed condition.

FIG. 4 is a plan view of a blank used in the manufacture of the container.

FIG. 5 is a perspective view of an alternative embodiment to the present invention.

BEST MODE FOR CARRYING OUT INVENTION

Figure 6:
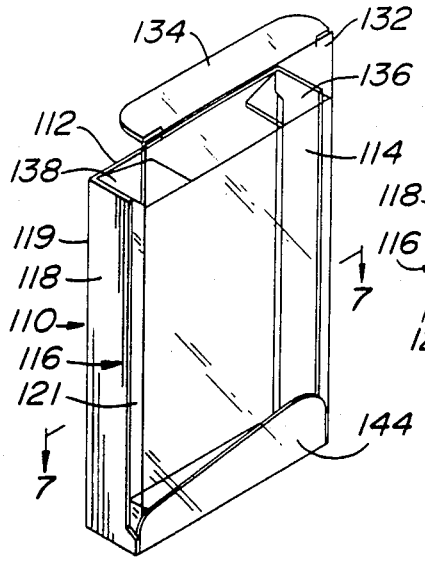
FIG. 6 is a perspective view of another embodiment of the present invention.
Figure 7:
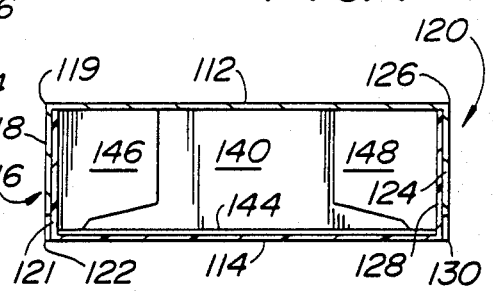
FIG. 7 is an enlarged sectional view taken along the line 7—7 in FIG. 6.
Figure 8:
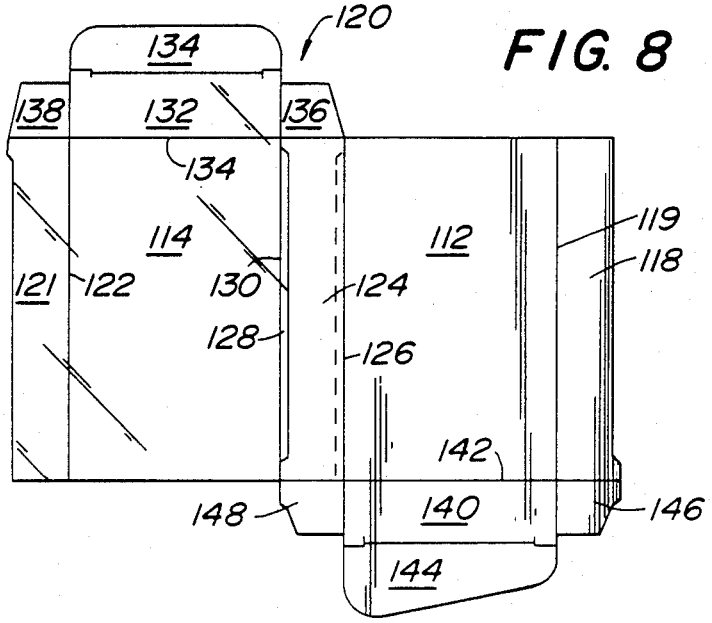
FIG. 8 is a plan view of a blank used in the manufacture of the container shown in FIG. 6.

Referring to the drawings in detail, wherein like numerals indicate like elements, there is shown in FIG. 1 a container in accordance with the present invention designated generally as 10. The container 10 includes a rear wall 12, a front wall 14, and side walls 16, 20. The rear wall 12 is longer and therefore larger than the front wall 14 to thereby provide a panel 13 which facilitates suspension of container 10 from a rack.

The side wall 16 is provided with integral panel or flange 18 and is connected thereto by a fold line. The side wall 20 is similarly connected to a panel or flange 22. The front wall 14 is connected to the side walls 16, 20 by a fold line.

The front wall 14 is connected at its upper end to a top wall or closure flap 24 having a tuck tab 26. Closure flap 24 is connected to the tab 26 and the front wall 14 by a fold line. A similarly constructed bottom wall or closure flap 28 and tuck tab 29 are connected to the bottom edge of the front wall 14. Side wall 16 has a side closure flap 30' connected at its upper end by a fold line and a similar side closure flap 30 connected to its lower end by a fold line. Side wall 20 is connected at its upper end to a side closure flap 32' by a fold line and at its lower edge to a side closure flap 32 by a fold line.

Elements 14, 16, 18, 20, 22, 24, 28, 29, 30, 30', 32, and 32' are made in one integral piece from a transparent or translucent polymeric material, such as a sheet of rigid polyvinyl chloride having a high impact resistance and a preferred thickness of about 0.010 gauge or ten thousandths of an inch. Any rigid or semi-rigid plastic material such as polyethylene, polystyrene, etc., may be used in place of the preferred plastic, polyvinyl chloride. One or more of the walls of said plastic sheet may be provided with printing or decoration.

The container 10 is rendered more rigid and less expensive to manufacture while having other advantages as a result of the fact that the rear wall 12 is made from an inexpensive rigid material different from the material used for the remainder of the container. The preferred material for the rear wall 12 is paperboard, cardboard or other inexpensive opaque material, since such material is easier and cheaper to decorate by printing than transparent polyvinyl chloride or other plastic material. Wall 12 is preferably preprinted before being attached to the remainder of the container which is in the form of a blank as shown in FIG. 4. One example of the versatility of the present invention is the ability to provide the inner or outer surface of the rear wall 12 with a decorative aluminum foil layer 34 bonded thereto. The foil layer 34 adds to the attractiveness of the package since it is visible directly or through the walls 14, 16, 20.

As shown more clearly in FIGS. 2 and 3, each of the flanges 18, 22 extend inwardly toward each other and overlie a side edge portion of the rear wall 12. Flanges 18 and 22 may be bonded, as for example by an adhesive or thermoplastic coating, to the rear wall 12. The container 10 may be stored and/or shipped in a flat condition as shown in FIG. 3 and may be easily erected, using automatic equipment if desired, into a self standing container 10 as shown in FIG. 1. The top wall or closure flap 24 is readily capable of being opened and closed a number of times to facilitate access to the contents of the container 10. The rear wall 12 provides added strength and rigidity to the container 10 to improve its ability to be self standing. Rear wall 12 may have printing and/or decorative material applied to either face thereof for reception of informative information with respect to the product, instructions of use of the product, the application of a trademark associated with the product, etc. The flanges 18 and 22 may be bonded to the inner or outer surface of the rear wall 12 as desired.

Thus, it will be seen that the container 10 has advantages over completely transparent containers of the prior art as well as advantages over composite packaging such as blister packages and transparent folding cartons. Such result has been accomplished without the use of costly molds, specialized production equipment, and without materially varying present production techniques. At the same time a stronger, less expensive container has been produced, which combats the economic forces of increased costs resulting from the increased cost of raw materials such as plastic sheet.

In FIG. 5, there is illustrated another embodiment of the present invention wherein the container is generally in the form of a sleeve structurally interrelated in the same manner as container 10 but lacking the top wall or closure flap 24, tuck tab 26 and tab 13. The sleeve-like container in FIG. 5 is otherwise identical with that described above with corresponding elements being identified by corresponding numerals. The sleeve-like container shown in FIG. 5 may be used as a package for paint brushes and the like wherein the bristles are visible through the transparent front and side walls. If desired, opposing walls of the sleeve 10 may be provided at their upper ends with tabs which fold back into the container to provide a stop edge which engages the encircling band of the brush to prevent longitudinal movement of the brush. Of course, the container of FIG. 5 can be used for packaging other types of articles.

In FIG. 6 there is shown a container 110 in accordance with another embodiment of the present invention. The container 10 includes a rear wall 112, a front wall 114, and side walls designated 116, 120. The side wall 116 is defined by a panel 118 connected to wall 112 by a fold line 119 and an overlapping panel 121. The panel 121 is integral in one piece with the front wall 114 and is connected thereto by a fold line 122. As illustrated, panel 118 partially overlaps panel 121 with the overlapping portions being bonded together in any convenient manner such as described above. Other variations are possible with respect to the amount of overlap of the panels 118, 121.

The side wall 120 is defined by a panel 124, which is connected to rear wall 112 by a fold line 126, and plastic panel 128. Panel 128 is integral in one piece with the front wall 114 and is connected thereto by the fold line 130. The amount of overlap of panels 124 and 128 may be the same as that in connection with side wall 116 or may be different. The overlapping portions of panels 124 and 128 are bonded together in any convenient manner such as the manners described above.

The front wall 114 is connected at its upper end to a top wall or closure flap 132 by way of a fold line **134*a*. The top wall 132 is connected by a fold line to a tuck tab 134. The panel 128 is connected at its upper end to a side closure flap or tab 136 by a fold line. The upper end of panel 121 is connected to a similar tab 138 by way of a fold line. Elements 114, 121, 128, 136, 132, 134, 138** are made in one integral piece from a transparent or translucent polymeric material such as that described above.

The bottom edge of the rear wall 112 is connected to a bottom wall or closure flap 140 by way of a fold line 142. The bottom wall 140 has a tuck tab 144 connected thereto by way of a fold line. The bottom edge of panel 118 has a side closure flap or tab 146 connected thereto by way of a fold line. The bottom edge of panel 124 has a similar tab 148 connected thereto by way of a fold line. Elements 112, 118, 124, 140, 144, 146 and 148 are made in one integral piece from an inexpensive rigid material different from the material used for the remainder of the container.

The preferred material for the last mentioned elements is the same as that set forth above in connection with rear wall 12. Thus, the advantages in connection with container 10 resulting from the material used for the rear wall 12 are equally applicable to the container 10. If it is desired to suspend container 110 from a hook, rear wall 112 may be provided with a tab on its uppermost end such as tab 13 of container 10. The tuck tab 144 is visible through the front wall 114 and may contain printing applied at the same time as printing is applied to the entire rear face of the rear wall 112.

Figure 9:
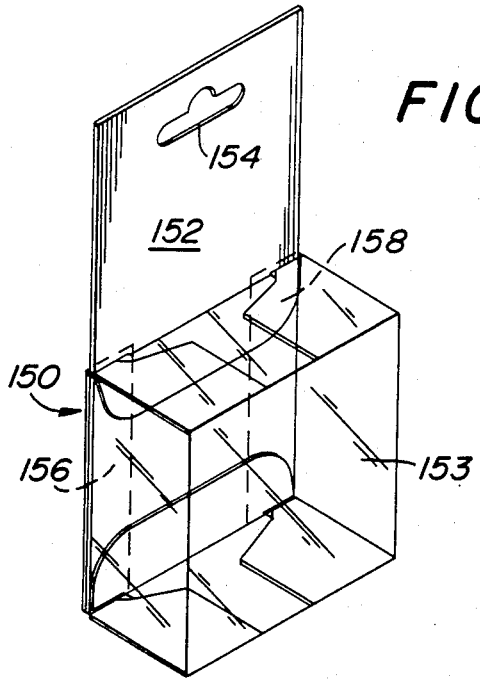
FIGS. 9, 10, 11, 12, 13, and 14 are front perspective views of other embodiments of containers according to this invention.

In FIG. 9, there is shown a container designated generally as 150. Container 150 is the same as container 10 except as follows. In container 150, the rear wall 152 is higher than front wall 153 so that it can accommodate the opening 154. Opening 154 facilitates suspending the container 150 from a rack. The flanges 156, 158 integral with the side walls overlap the rear surface of rear wall 152.

Figure 10:
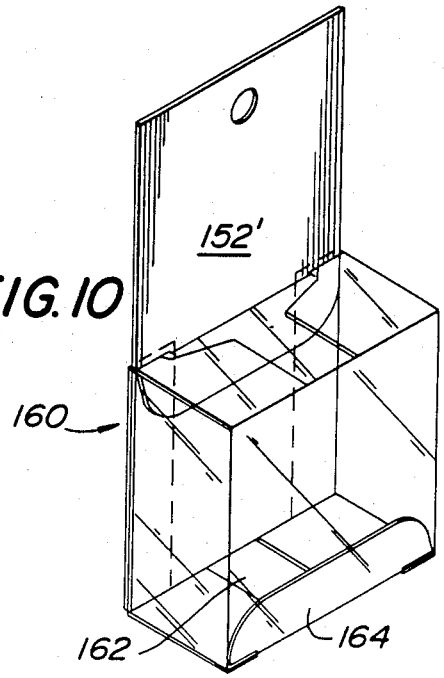

In FIG. 10, there is shown a container 160 which is the same as container 150 except as follows. In container 160, the bottom wall 162 has a tab 164 and is integral with the rear wall 152'.

Figure 11:
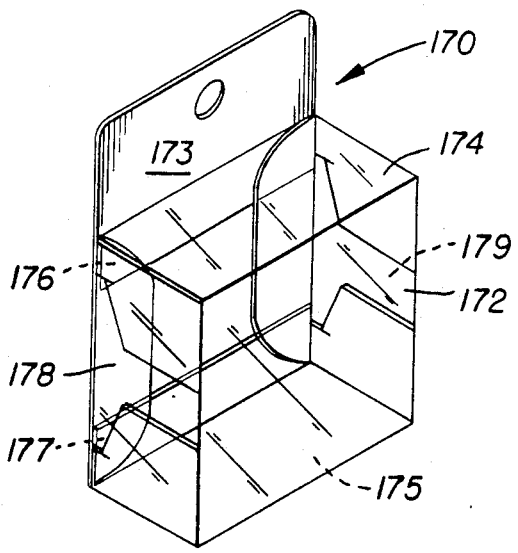

Referring to FIG. 11, the container 170 there illustrated is similar in construction to that shown in FIG. 9. However, in FIG. 11, the front wall 172, which is of clear plastic, is attached to the rear wall 173 by top and bottom walls 174 and 175, respectively, which walls are integral with the front wall 172. Top wall 174 has a flange 176 and bottom wall 175 has a flange 177 by means of which the said walls are attached to the front surface of rear wall 173. Access to the interior of the package is by means of opposing closure flaps 178 and 179, each of which has a tuck tab.

Figure 12:
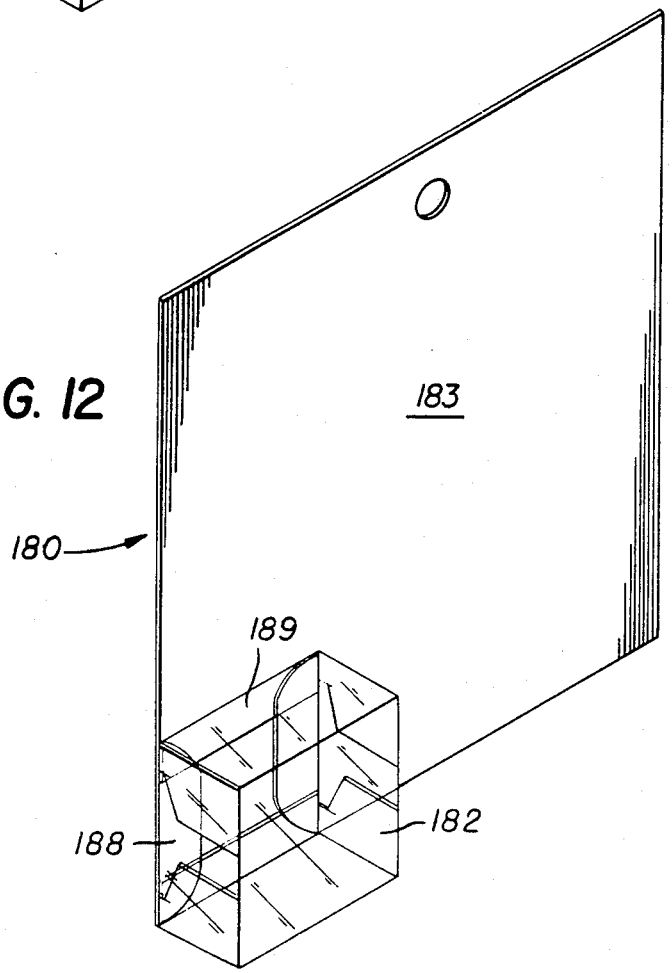

The container 180 of FIG. 12 is similar to that of FIG. 11 with the exception that the opaque rear wall 183 is considerably larger than front wall 182 both in length and width. Such an arrangement is particularly useful where it is desirable to include on the rear wall considerable printed matter, such as a description of the packaged product and detailed instructions for its use. Access to the interior of the package can be had by way of side closure flap 188.

The containers 10, 110, 150, 160, 170 and 180 are collapsible in the same manner as described above. In the embodiments of FIGS. 1–5 and 9–12 described above, the transparent front wall has integral side or top and bottom wall panels which overlie and are bonded to portions of the rear wall. Also, at least one of the side, top or bottom walls is integral with a front wall and comprises a closure flap adapted to facilitate repeated access to the interior of the container. In each embodiment there is provided a composite container having the option of printing only on the opaque rear wall to minimize printing costs, or on both the transparent front and opaque rear walls.

Figure 13:
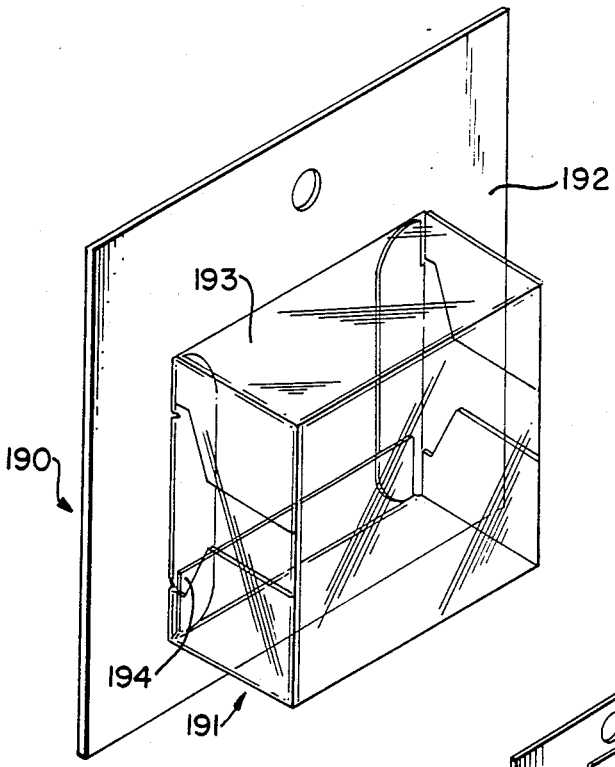

Referring to FIG. 13, there is shown a container 190 which is the same as containers 170 and 180 except for the position of the display package 191 on the card 192 and the fact that instead of a flange 176 or a flange 189, display package 191 includes a rear wall 193 which is adhesively secured to flange 194 instead of, for example, the flange 177 of container 170. Thus, display package 191 is a complete box or container by itself and is adhesively connected to the card 192. Container 190 has all of the advantages of the previous container except that it is not as economical because of the additional plastic material required to provide a complete rear wall 193 rather than a flange, such as either flange 176 or 189. Also, it would not be manufactured in a single operation from a unitary package blank as the display package 191 would be manufactured and then combined with the card 192.

Figure 14:
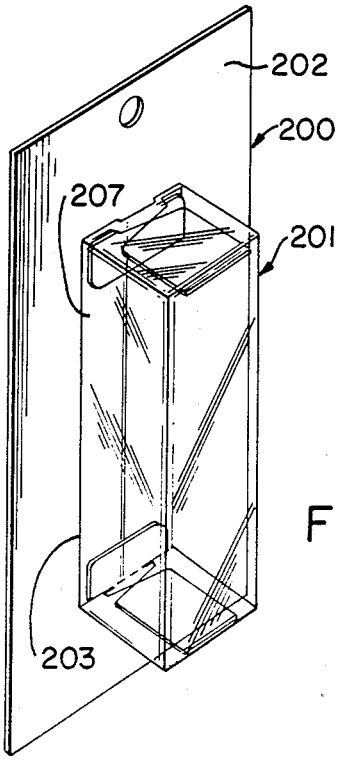
Figure 15:
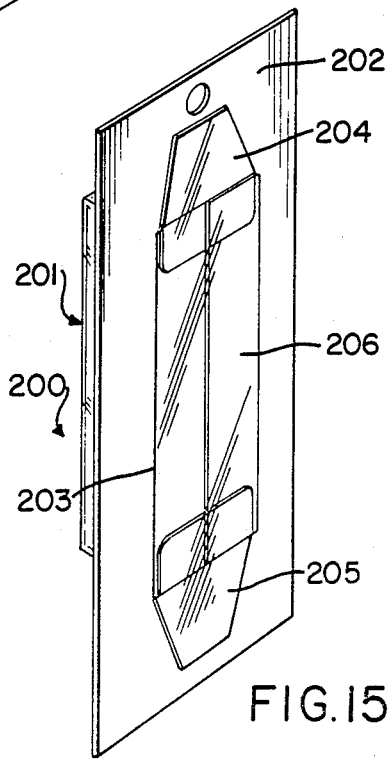
FIG. 15 is a rear perspective view of the embodiment of FIG. 14.

Referring now to FIGS. 14 and 15, there is shown a container 200 including an all plastic display package 201 and a paperboard card 202. A rectangular cutout portion 203 is disposed substantially centrally in card 202. Display package 201 is disposed in cutout portion 203 and retained in such position by its cooperation therewith and flange members 204 and 205 which are adhesively secured to the back of card 202. Container 201 enjoys all of the advantages of the previous containers except for the waste involved in producing the cutout portions 203 and the need for sufficient plastic material to form a complete package of the type exemplified by display package 191. Thus, display package 201 includes a complete plastic rear wall 206 and internal flange 207. It also would not be manufactured in a single operation from a unitary package blank.

The present invention may be embodied in specific forms thereof other than those described herein without departing from the spirit or essential attributes thereof. For example, a plastic display package could be disposed in a cutout corner of a card and secured thereto by a flap. Also, instead of securing the flaps 204 and 205 to the card 202 of container 200, the display package 201 could be held in place by placing a second card against the back of card 202 and securing the cards together, thus locking the display package in place. Therefore, it is intended that the present invention be defined by the appended claims.

We claim:

1. A container made of a first sheet of transparent or translucent plastic substantially rigid, self-supporting material, a second sheet of substantially rigid, self-supporting material, joining means comprising at least two flange portions connecting said first and second sheets together at least along said two flange portions to form a unitary composite container, discrete fold lines in said container including at least a pair of discrete fold lines formed in said first sheet of material, said discrete fold lines being disposed and constructed to cooperate to form a walled enclosure when a container is in its setup condition, to form a substantially flat configuration when the container is in its fully collapsed condition, and so that said walled enclosure is movable between its setup condition and its fully collapsed condition by movement of the walls of said walled enclosure relative to each other, said second sheet of material including a portion extending beyond said walled enclosure to provide an extended portion, and at least one of said two flange portions is disposed adjacent to and connected to a first side of said second sheet so that said walled enclosure is disposed adjacent to and one said first side of said second sheet.

2. A container according to claim 1, wherein both of said two flange portions are connected to said first side of said second sheet.

3. A container according to claim 1, wherein said extended portion in both wider than and longer than said walled enclosure.

4. A container according to claim 1, wherein said enclosure comprises top and bottom walls integral with a front wall and connected thereto by fold lines to facilitate access to the interior of the enclosure, a rear wall defined by said second sheet, and said top and bottom walls are disposed generally perpendicular to said front and rear walls when said enclosure is in its setup condition.

5. A container according to claim 1, wherein said second sheet of material is paperboard.

6. A container according to claim 2, wherein said flange portions are integral with at least one of said sheets of material.

7. A container according to claim 5 or 6, wherein said flange portions are integral with said first sheet of material.

8. A container according to claim 1, wherein said flange portions comprise a pair of elongated substantially parallel flanges.

9. A container according to claim 8, wherein said flanges are disposed within said walled enclosure.

10. A container according to claim 9, 1 or 2, wherein said extended portion includes hanging means for container display.

11. A container according to claim 1, 2 or 3, wherein said second sheet of material is substantially rectangularly shaped.

12. A container according to claim 1, further comprising closure means for closing at least one end of said enclosure.

13. A container according to claim 12, wherein said closure means include closure members integral with at least one of said first and second sheets of material.

14. A container according to claim 12 or 13, wherein said closure means at said at least one end of said enclosure can be opened and closed without substantial deleterious effect on same.

15. A container according to claim 12 or 13, wherein said closure means are integral with said first sheet of material.

16. A container according to claim 12 or 13, wherein said closure means are constructed to permit the formation of closures at both ends of said enclosure when the container is in its setup position.

17. A container according to claim 1, 2 or 3, wherein all of said discrete fold lines are in said first sheet of material.

18. A container according to claim 1, 2 or 3, wherein said second sheet includes a layer of paper with printing on a face thereof.

19. A container according to claim 4, wherein said rear wall is a laminate with one layer thereof being a layer of paperboard having printing on at least one face thereof.

20. A container according to claim 19, wherein one of said layers of laminate is a foil layer on the inner surface of said rear wall so as to be visible through at least the transparent or translucent front wall.

* * * * *

UNITED STATES PATENT AND TRADEMARK OFFICE

CERTIFICATE OF CORRECTION

PATENT NO. : 4,858,756

DATED : August 22, 1989

INVENTOR(S) : M. Herrin, et al.

It is certified that error appears in the above-identified patent and that said Letters Patent is hereby corrected as shown below:

Column 5, line 19, after "24", insert -- 26, --.
Column 6, line 31, "10" should read -- 110 --.
Column 8, line 47, "a container" should read -- the container
Column 8, line 58, "one" should read -- on --.
Column 8, line 64, "in" should read -- is --.
Column 9, line 9, "2" should read -- 5 --.
Column 9, line 12, "5 or 6," should read -- 1, 5 or 6 --.

Signed and Sealed this

Eighteenth Day of September, 1990

*Attest:*

HARRY F. MANBECK, JR.

*Attesting Officer*

*Commissioner of Patents and Trademarks*